United States Patent [19]

Bohg et al.

[11] Patent Number: 4,651,640

[45] Date of Patent: Mar. 24, 1987

[54] PRINT HAMMER BANK IN MODULAR DESIGN

[75] Inventors: Armin Bohg, Weil-Neuweiler; Kurt Hartmann, Calw-Heumaden, both of Fed. Rep. of Germany

[73] Assignee: International Business Machines Corporation, Armonk, N.Y.

[21] Appl. No.: 772,500

[22] Filed: Sep. 4, 1985

[30] Foreign Application Priority Data

Sep. 10, 1984 [EP] European Pat. Off. ..... 84110756

[51] Int. Cl.[4] ..... B41J 9/10

[52] U.S. Cl. ..... 101/93.48; 101/93.29; 335/256; 335/267; 335/268

[58] Field of Search ..... 101/93, 93.09, 93.29, 101/93.34, 93.48; 375/256, 259, 264, 266, 267, 268, 282

[56] References Cited

U.S. PATENT DOCUMENTS

| | | | |
|---|---|---|---|
| 3,183,417 | 5/1965 | Wright | 317/164 |
| 3,209,891 | 10/1965 | Littwin | 198/41 |
| 3,800,257 | 3/1974 | Schmitt | 335/259 |
| 3,890,587 | 6/1975 | Field | 335/264 |
| 4,371,857 | 2/1983 | Bohg et al. | 335/267 |
| 4,377,799 | 3/1983 | Froment | 335/256 |
| 4,425,845 | 1/1984 | Bohg et al. | 101/93.34 |

FOREIGN PATENT DOCUMENTS

| | | |
|---|---|---|
| 2713514 | 9/1978 | Fed. Rep. of Germany . |
| 2528257 | 6/1982 | France . |

OTHER PUBLICATIONS

Tech. Disclosure Bulletin—Horizontal Sliding Print Hammer Mechanism Apr. 1983, vol. 25, No. 11B–W. A. Patterson and W. D. Thorne.

*Primary Examiner*—Edgar S. Burr
*Assistant Examiner*—David A. Wiecking
*Attorney, Agent, or Firm*—E. Ronald Coffman

[57] ABSTRACT

The invention relates to a print hammer bank of electromagnetic print hammer actuators in modular design of the type which includes a plurality of actuators each of which comprises a stator formed in two halves, each half including an electromagnet and a plurality of pole pieces, and means for positioning the stator halves relative to each other so that the ends of the pole pieces of the two halves are spaced apart in pairs so as to form a plurality of aligned operating gaps. The armature elements are designed so that the volume of each armature element is of the order of the volume of the associated operating gap.

A print hammer bank in accordance with the invention is characterized in that the print hammer bank consists of two spaced apart rows of modules of the same geometrical shape and design forming the stator halves with the armature members located side by side in the space between the rows of modules, in that, for adjacent print hammers, the associated electromagnets are staggered relative to each other within the associated module, and in that each module, looking at the side facing the armature members, is shaped like a parallelogram.

3 Claims, 7 Drawing Figures

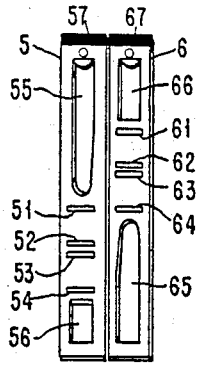
FIG. 3
FIG. 4
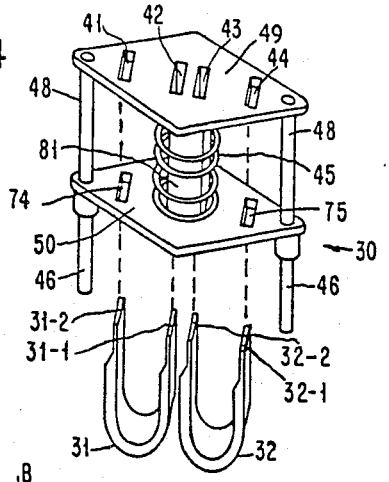
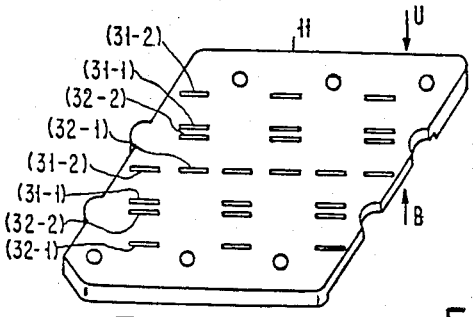
FIG. 2A
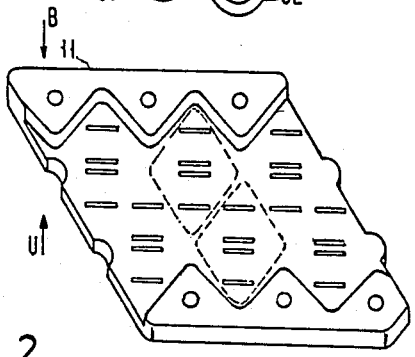
FIG. 2B
FIG. 2
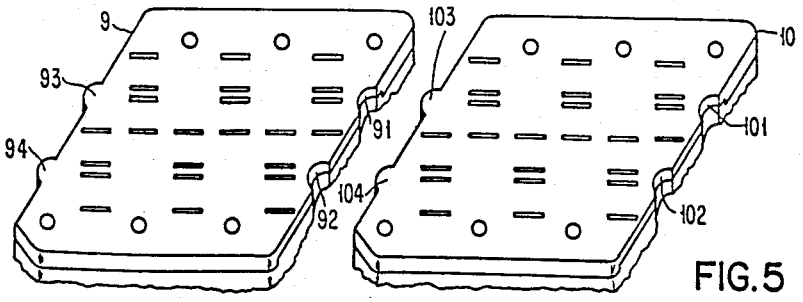
FIG. 5
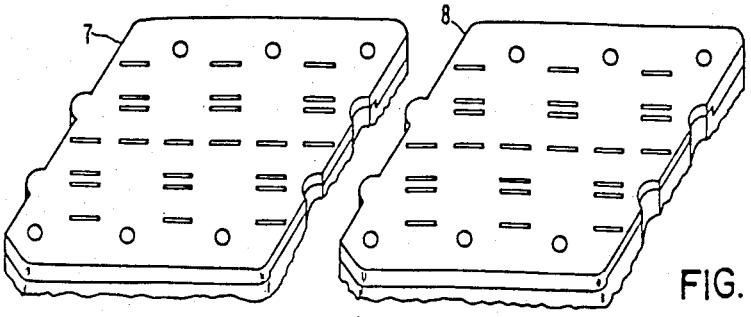
FIG. 6

PRINT HAMMER BANK IN MODULAR DESIGN

FIELD OF THE INVENTION

The present invention relates to impact printers of the type including a bank of electromagnetic hammers which are actuated selectively in order to perform printing operations on a print medium, for example a sheet of paper.

The present invention relates to the construction of such a print hammer bank.

BACKGROUND OF THE INVENTION

The present invention relates to electromagnetic print hammer actuators of the type described in the Canadian Pat. No. 1135317 particularly with reference to FIGS. 1*a*, 1*b*, 2, 3, 4 and 6.

Hammer actuators in the Canadian Patent comprise a stator and a movable armature member or ram that forms the hammer. The stator consists of two substantially symmetrically constructed magnetizable yoke halves with one or more excitation coils. Each yoke half is formed with two or more pole pieces. The yoke halves are positioned so that the ends of the pole pieces of one yoke half are aligned with the ends of the pole pieces of the other yoke half. The facing pole piece ends are spaced apart so as to form magnetic operation gaps. These gaps are aligned along the length of the stator.

The armature member or ram is located in the gaps between the stator halves and is movable relative to the stator in the direction of alignment of the gaps. The cross section of the ram is substantially the same as the cross section of the gaps defined by the shapes of the ends of the pole pieces. This cross section can be circular or rectangular. The body of the ram is made from a non-magnetizable material and includes armature elements of a magnetizable material. The armature elements extend substantially across the full width of the ram so that their cross section is substantially the same as the cross section of the ram and of the gaps. When the ram is in its rest position each armature element is located adjacent to a respective one of the magnetic operating gaps and the length of each armature element is substantially equal to the length of the associated gap. As a result the armature elements are geometrically shaped so that the volume of each armature element is of the order of the volume of the associated gap.

When the ram is in its rest position each armature element is located substantially outside its associated operating gap. Upon excitation of the coil or coils of the stator the resultant magnetic field causes each armature element to be pulled into its associated gap and the ram is accelerated along its length as it is constrained to move in a straight line. A hammer is formed at one end of the ram and this is used to perform a printing operation.

U.S. Pat. No. 4,425,845, describes an arrangement for accommodating a plurality of ram units positioned adjacent to one another into a hammer bank. Each ram unit consists of a flat, narrow frame. A tongue-shaped ram, to be driven by an electromagnetic actuator, is slidably received in a recess in the frame. For accommodating and guiding the individual print ram units, the bank is provided with a receiving bar and a comblike holding bar between which the frames of the units are arranged. Extension pieces of the lower elements of the frames are accommodated in slits in the receiving bar. The upper elements of the frames are held in recesses in the comb-like holding bar. Each tongue-shaped ram is guided laterally by two electromagnetic actuators which are arranged one on each side of the frame and are aligned relative to each other.

Such a print hammer bank has a number of disadvantages including that it is expensive to manufacture and its ram units are difficult to exchange and are susceptible to oscillations.

There is described in IBM Technical Disclosure Bulletin, Volume 25, No 11B, April 1983, pages 6284/85 another type of print hammer bank in which a plurality of print hammer actuators are positioned adjacent to one another. Each actuator includes a stator having two yoke halves and a movable tongue shaped ram armature member formed at one end with a hammer. The rams are located in a common horizontal plane and for each ram the two stator yoke halves are located on opposite sides of this common plane. The rams extend closely adjacent to one another. The stator for each ram is wider than the associated ram and therefore extends beyond the sides of the ram. In order to reduce the overall length of the hammer bank the stators of adjacent rams are staggered. The stators for one set of rams are positioned towards the hammer ends of the rams and the stators of another set of rams which are interleaved between the rams of the first set are positioned towards the other ends of the rams.

The object of the present invention is to provide an improved print hammer bank which is compact and of such a construction that it is easy to replace defective components.

It is another object of the invention to provide a print hammer bank having a modular design which tends to eliminate the above mentioned disadvantages of known types of print hammer bank.

SUMMARY OF THE INVENTION

The invention relates to a print hammer bank made up of modular stator elements. The stator modules are formed in two halves, each half including an electromagnet and a plurality of pole pieces. The stator halves are interconnected by spaces so that the ends of the pole pieces of the two halves are spaced apart in pairs so as to form a plurality of aligned operating gaps. A ram including a plurality of armature elements of magnetizable material is slidably received and guides in tracks formed between the two stator halves in a position so that each of the armature elements is located adjacent to a respective one of the operating gaps. The volume of armature elements is sized to be of the order of the volume of the associated operating gap. When the electromagnets associated with a particular ram are excited, the ram is magnetically driven from a rest position in which the armature elements of the armature member are located outside their respective operating gaps toward a hammer operating position in which each armature element is located within its respective operating gap.

The modules are arranged to overlap in a staggered offset fashion that contributes to the stiffness of the bank as a whole. This staggered overlap is achieved by making the modules of parallelogram or diamond shape so that the parting line between adjacent modules is at a substantial angle to the direction of ram travel.

Further, the parting line of the upper module halves is not parallel, but transverse to the parting line of the lower module halves.

In addition, the electromagnets associated with the stator halves are constructed with diamond shaped forms which permit adjacent electromagnets to be nested compactly together.

The modules are parallelogram or diamond shaped; the gaps between adjacent modules in one row coincide with the gaps between adjacent modules in the other row.

BRIEF DESCRIPTION OF THE DRAWINGS

These and other objects, features and advantages of the invention will be more fully understood by those working in the art by reading and understanding the following description of a preferred embodiment of the invention wherein reference is made to the accompanying drawings, of which:

FIG. 2 is a schematic perspective representation of a module base plate, in which FIG. 2A is a perspective view of the module base plate showing the side facing the print hammers, and FIG. 2B is a perspective view of the module base plate of FIG. 2A rotated through 180° about axis 1 showing the side averted from the print hammers, FIG. 3 is a plan view of two adjacent print hammer rams in the print hammer bank illustrated in FIG. 1, showing how the actuating armature bars or elements of the hammers are staggered relative to each other, FIG. 4 is an exploded view of a schematic perspective representation of the electromagnet assembly used in the print hammer bank illustrated in FIG. 1 and consisting of two U-shaped yokes which are positioned adjacent to each other with their adjacent legs encompassed by a coil, FIG. 5 is a perspective view of two adjacent module base plates of the upper module row of the print hammer bank illustrated in FIG. 1 showing the side of each module base plate facing the print hammers, FIG. 6 is a perspective view of two adjacent module base plates of the lower module row of the print hammer bank illustrated in FIG. 1 showing the side of each module base plate facing the print hammers.

DETAILED DESCRIPTION OF THE INVENTION

Figure 1:
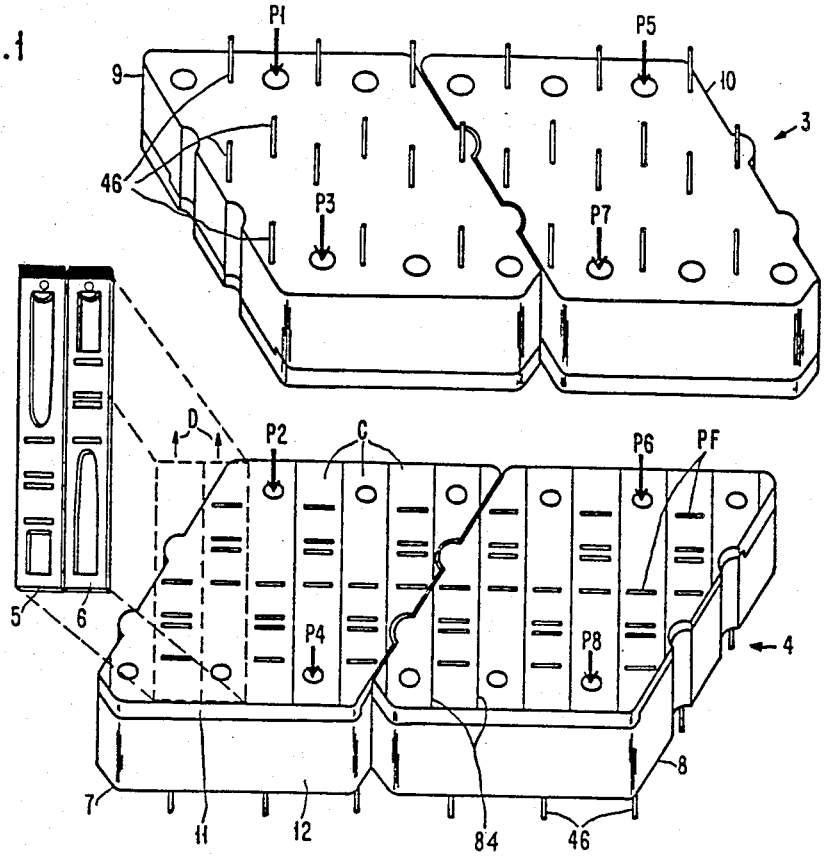
FIG. 1 is an exploded view of a schematic perspective representation of the upper and the lower module rows of a print hammer bank embodying the invention and having interposed adjacent print hammers.

FIG. 1 is an exploded view of a schematic perspective representation of the lower and the upper module rows of a print hammer bank embodying the invention and having interposed adjacent print hammers.

The print hammer bank is made up of identically shaped modules 7, 8, 9, 10. Each module in plan view is shaped like a parallelogram or diamond. Each module consists of a module base plate (e.g. 11 in the case of module 7) and a stator member 12 connected thereto. Electromagnet assemblies 30 (FIG. 4) are located in and molded to the stator member 12. Adjacent modules 9 and 10 form an upper row 3 and adjacent modules 7 and 8 form a lower row or portion 4. The upper module row or portion 3 and the lower module row 4 are spaced from each other as shown in greater detail with respect to FIG. 7.

Two print hammers, 5 and 6, are shown in FIG. 1. The print hammers are supported adjacent to each other between the upper module row and the lower module row for movement in the direction of arrow D. On the side facing the print hammers, each module 7, 8, 9, 10 has a plurality of pole faces PF of the electromagnet yokes. The pole faces of the upper module row are aligned with those of the lower module row in pairs. The spaced pairs of pole faces of the upper and the lower module rows define a plurality of magnetic operating gaps. These operating gaps are activated by electromagnetic coil excitation.

The pole faces PF are arranged in tracks or columns (C) associated with individual print hammers. In FIG. 1, each column of a module has four pole faces. Each print hammer (illustrated in FIG. 3) has as many soft iron bars (armature bars or elements) as there are operating gaps defined by the pole faces in its associated columns. In the print hammer described, the number of soft iron bars is four. The spacing of the soft-iron bars in each print hammer corresponds to the spacing of the operating gaps in the associated columns of the print hammer bank so that each soft iron bar is associated with a respective operating gap. The soft iron bars are designed so that the volume of each soft iron bar is of the order of the volume of its associated operating gap.

When each print hammer is in its rest position, each soft-iron bar in the hammer is positioned outside its associated operating gap. When the magnetic operating gaps for each print hammer are activated by energising the associated electromagnetic coil, the armature bars of the print hammer are pulled into the operating gaps. The print hammer is accelerated in this process in the direction of print illustrated by the arrows D.

The modules of each module row are positively connected to each other. For forming the operating gaps, the modules of the upper module row 3 and the modules of the lower module row 4 are spaced from each other by spacer elements (see FIG. 7). The modules of the upper row 3 and the lower row 4 are held in place by screws or rivets or similar joining devices. Such joining devices may extend, for example, through the arrow-marked through holes P1/P2, P3/P4, P5/P6, P7/P8. On the side of each module averted from the print hammers, a plurality of connector pins 46 are provided for connection to the electromagnet assemblies. The electromagnet assemblies, the spacer elements for the module rows, the positive connection of the modules within a row and the layout and structure of the modules will be described in greater detail below.

Figure 7:
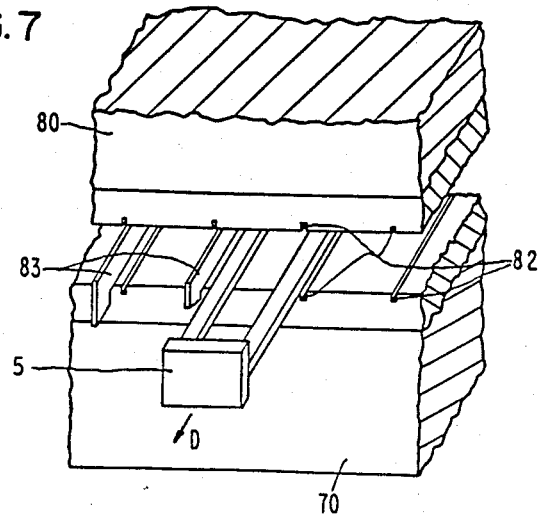
FIG. 7 is a schematic perspective representation of a print hammer positioned between the upper and the lower module rows of the print hammer bank illustrated in FIG. 1.

The lines 84 defining the boundaries between adjacent columns or tracks C will be described in detail below with reference to FIG. 7.

The shapes of the modules in plan view are identical and are based on a modified parallelogram. This design provides a high packing density of the print hammers. The pole faces of the electromagnet assemblies in adjacent columns are staggered relative to each other and the armature bars or elements of adjacent print hammers are also staggered relative to each other to cooperate with the staggered pole faces. If the shapes of the modules in the print hammer bank are identical in both the upper and the lower module rows, the number of print hammers for each module is invariably even.

FIG. 4 is an exploded view of a schematic perspective representation of one of the electromagnet assemblies used in the print hammer bank. The electromagnet assembly consists of two adjacent U-shaped yokes 31 tion and a further plurality of stator modules assembled into an upper stator portion, means interconnecting said upper and lower stator portions to form a series of rectilinearly extending track spaces therebetween, the modules of each portion having mutually adjacent side edges that extend at an angle substantially greater than zero degrees with respect to said rectilinear track spaces, the side edges of the modules of the upper portion extending at an angle substantially greater than zero degrees with respect to the adjacent side edges of modules of the lower portion and wherein each module of said upper portion overlies and is connected to at least two modules of the lower portion, a plurality of rams movably positioned individually in different ones of said track spaces, each of said rams comprising a non-magnetic body and at least a pair of magnetizable armature pieces carried by said body, and said modules further comprising a plurality of electromagnets carried by said stator portions in opposed pairs adjacent individual track spaces, each of said electromagnets providing at least a pair of pole faces positioned adjacent individual armatures pieces of associated rams.

2. A modular print hammer bank as defined in claim 1 wherein said modules are substantially identical and are formed in the shape of parallelograms with one pair of included angles being substantially greater than a right angle and the other pair of included angles being substantially less than a right angle.

3. A modular print hammer bank as defined in claim 2 wherein at least some of said track spaces overlie said angled side edges, at least four electromagnets being associated with each of said track spaces, two of said electromagnets being carried by modules of said upper stator portion and two of said electromagnets being carried by modules of said lower stator portion, and wherein the two upper stator portion electromagnets and the two lower stator portion electromagnets associated with a track space that overlies an angled side edge are each separately carried by adjacent ones of said modules.

* * * * *